United States Patent [19]

Harnish

[11] Patent Number: 4,517,807

[45] Date of Patent: May 21, 1985

[54] HEAT PUMP WATER HEATER WITH SUPPLEMENTAL HEAT SUPPLY

[75] Inventor: James R. Harnish, York, Pa.

[73] Assignee: Borg-Warner Corporation, Chicago, Ill.

[21] Appl. No.: 640,891

[22] Filed: Aug. 14, 1984

Related U.S. Application Data

[63] Continuation of Ser. No. 416,435, Sep. 10, 1982, abandoned.

[51] Int. Cl.[3] ..... F25D 21/06

[52] U.S. Cl. ..... 62/156; 62/238.6; 165/29; 237/2 B

[58] Field of Search ..... 62/160, 156, 151, 181, 62/180, 179, 238.6, 238.7, 324.5; 165/29; 237/2 B; 219/321, 330

[56] References Cited

U.S. PATENT DOCUMENTS

| | | | |
|---|---|---|---|
| 1,892,557 | 12/1932 | McCormick | 219/321 |
| 2,095,017 | 10/1937 | Wilkes et al. | 165/29 X |
| 2,102,940 | 12/1937 | Buchanan | 237/12.4 |
| 2,716,866 | 9/1955 | Silva | 165/29 X |
| 2,847,190 | 8/1958 | Slattery et al. | 165/29 X |
| 3,159,981 | 12/1964 | Huskey | 62/156 |
| 3,922,876 | 12/1975 | Wetherington, Jr. et al. | 62/180 |
| 4,098,092 | 7/1978 | Singh | 62/238 |
| 4,102,391 | 7/1978 | Noland et al. | 165/29 |
| 4,141,222 | 2/1979 | Ritchie | 62/179 |
| 4,143,707 | 3/1979 | Lewis et al. | 62/160 X |
| 4,173,872 | 11/1979 | Amthor, Jr. | 62/238 |
| 4,314,456 | 2/1982 | Harnish | 62/181 |
| 4,363,221 | 12/1982 | Singh | 62/286.6 |

*Primary Examiner*—Harry Tanner
*Attorney, Agent, or Firm*—Julian Schachner

[57] ABSTRACT

There is disclosed a heat pump water heater with supplemental heat supply wherein the heat pump is turned on when water has cooled below a predetermined temperature, and is turned off when the water has been heated to a predetermined temperature. In the event frost begins to form on the surface of the heat pump evaporator, the heat pump is turned off and the supplemental heat supply turned on automatically. This condition prevails until the water has been heated to a predetermined temperature, at which time the supplemental heat supply is turned off.

20 Claims, 2 Drawing Figures

HEAT PUMP WATER HEATER WITH SUPPLEMENTAL HEAT SUPPLY

This is a continuation of application Ser. No. 416,435 filed Sept. 10, 1982, abandoned.

BACKGROUND OF THE INVENTION

This invention relates generally to a heat pump water heater with supplemental heat supply. More particularly, it is directed to such a heater wherein the heat pump is turned off and the supplemental heat supply turned on in the event a frost condition is sensed at the heat pump evaporator.

Heat pump water heaters have been known for many years. Although they are economical to operate, they have not been used extensively heretofore because power, particularly electric power, has been inexpensive. As the cost of power increases, there is renewed interest in the use of heat pump water heaters, particularly for providing domestic hot water.

When a heat pump is incorporated as part of a dedicated hot water supply system, the entire heat pump typically is located in a basement or utility room. There, in addition to heating water, it performs a dehumidifying function.

Although the surrounding indoor air generally contains enough heat to allow efficient heat pump operation, there are occasions when the wet bulb air temperature may approach freezing, in which case frost begins to form on the evaporator. In such an event the heat pump becomes inefficient, and its heating capacity is no longer adequate to meet the hot water requirements.

One solution to this problem would be to provide the heat pump with a defrosting capability. However, this would add significantly to the cost. Another solution would be to provide a manual override which allows the heating elements of the hot water tank to be turned on independently of the heat pump. However, this assumes that the user has knowledge of the problem, and could require a period of up to two hours before water in the tank comes up to the desired temperature.

There remains a need in the art for a heat pump water heater which provides supplemental heat automatically in the event a frost condition is sensed at the heat pump evaporator. It should be simple, efficient and cost-effective, and should be easily installed on-site.

SUMMARY OF THE INVENTION

The primary object of this invention is to meet the needs noted above. To that end, there is disclosed a heat pump water heater with a supplemental heat supply. When there is a demand for hot water, the heat pump is cycled on. If a frost condition is sensed at the evaporator, the heat pump is turned off and the supplemental heat turned on automatically. This condition prevails until water in the tank reaches a predetermined temperature, at which time the system is recycled to its original condition.

In summary, the invention relates to a heat pump water heater with supplemental heat supply comprising a heat pump including an evaporator, a hot water tank, supplemental water heating means, tank temperature sensing means, and means for controlling the operating cycle of the heater. The control means includes means for sensing the formation of frost on the evaporator. It initiates the operating cycle by turning on the heat pump when water temperature in the tank has decreased below a predetermined temperature, and concludes the operating cycle by turning off the heat pump when water temperature in the tank has increased to a predetermined temperature. The control means continues the operating cycle when necessary by turning off the heat pump and turning on the supplemental heating means in the event frost begins to form on the evaporator, and concludes the operating cycle by turning off the supplemental heating means when water temperature in the tank has increased to a predetermined temperature.

BRIEF DESCRIPTION OF THE DRAWING

The objects and advantages of this invention will become apparent to those skilled in the art upon careful consideration of the specification herein, including the drawing, wherein.

Figure 1:
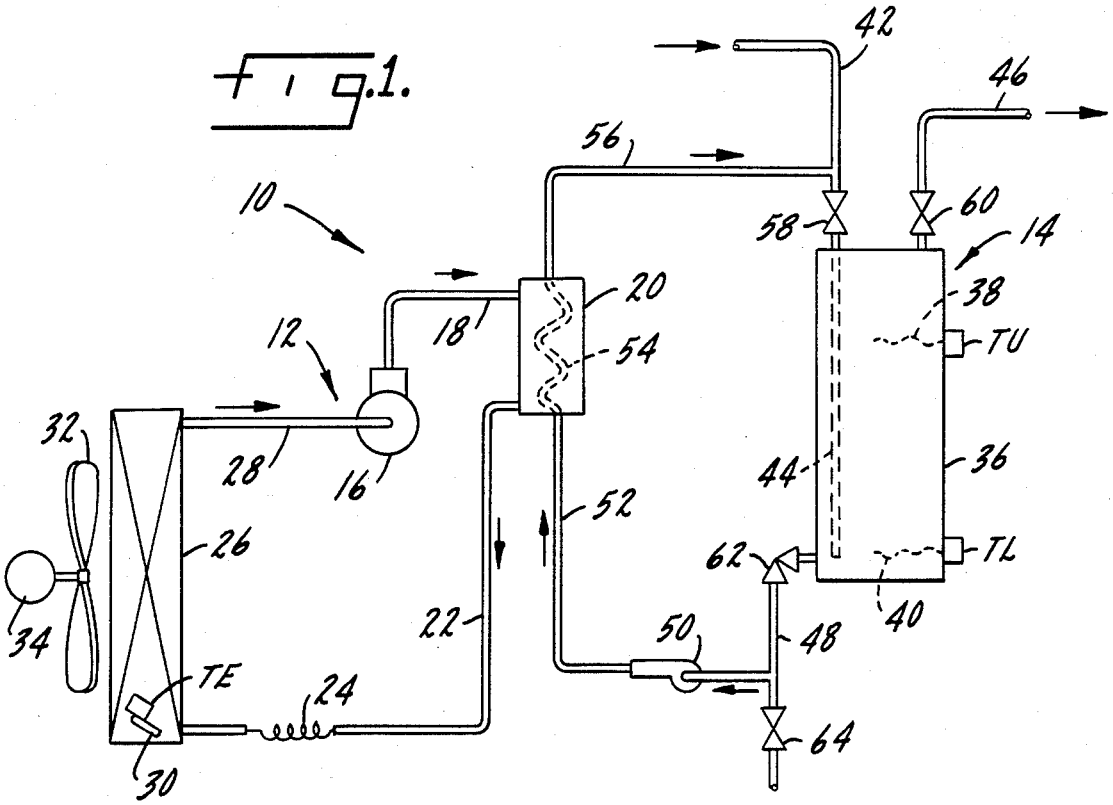
FIG. 1 is a diagrammatic illustration of the heat pump water heater with supplemental heat supply.

While this invention is susceptible of embodiment in many different forms, the preferred embodiment is shown in the drawing and described in detail. It should be understood that the present disclosure is considered to be an exemplification of the principles of the invention, and is not intended to limit the invention to this embodiment.

DESCRIPTION OF THE PREFERRED EMBODIMENT

Turning now to the drawing in greater detail, reference numeral 10 designates generally a heat pump water heater with supplemental heat supply. The heater includes a heat pump 12, which may be of the refrigerant condensing type, and a hot water delivery system 14, which provides the supplemental heat.

Heat pump 12 includes a compressor 16, preferably driven by a single-phase motor of the permanent split-capacitor type. A refrigerant conduit 18 communicates compressor 16 with a water-cooled condenser 20. A refrigerant conduit 22 communicates condenser 20 through an expansion device 24, which may be a capillary tube, with an evaporator 26. To complete the refrigeration circuit, a refrigerant conduit 28 communicates evaporator 26 with compressor 16.

Evaporator 26 includes a plurality of tubes, not shown. A plurality of return bends 30, one of which is shown in FIG. 1, connect the tube ends so that they communicate refrigerant through evaporator 26. If desired, a fan 32 driven by a fan motor 34 may be provided to bring air into heat-exchanging relationship with the tubes of evaporator 26.

An evaporator thermostat TE is located at one of return bends 30. This thermostat senses refrigerant temperature, which is related to the wet bulb temperature on the surface of evaporator 26. Thus, evaporator thermostat TE effectively senses evaporator surface temperature, and can be set to turn off when this temperature decreases to the point at which frost begins to form on evaporator 26.

Hot water delivery system 14 includes a hot water tank 36 provided with upper and lower heating elements 38 and 40, respectively. Also provided are upper and lower tank thermostats TU and TL, respectively.

An inlet water line 42 directs cold make-up water to an internal water passage 44 which opens into the lower portion of tank 36. An outlet water line 46 supplies hot water to the user.

What normally would be a drain water line 48 communicates the lower portion of tank 36 with a circulating pump 50. A water line 52 communicates pump 50 with a heat exchanger coil 54 located in condenser 20. To complete the water circuit, a water line 56 communicates coil 54 with line 42.

Suitable valves 58, 60 and 62 are provided to facilitate installation and/or maintenance of tank 36. An additional drain valve 64 is provided in line 48.

As an equipment package for the new construction market, heater 10 includes heat pump 12 and hot water delivery system 14, essentially as shown in FIG. 1. Installation would involve on-site connection to lines 42, 46 and 48.

In an alternative embodiment of this invention, not shown in the drawing, an equipment package for the new construction market does not require pump 50, line 52, coil 54 and line 56. In this embodiment, condenser 20 is located within tank 36.

As an aftermarket package, heater 10 includes heat pump 12, pump 50, line 52, coil 54 and line 56. On-site installation to an existing hot water delivery system 14 would involve connection to lines 42 and 48. The aftermarket package is designed to use heating elements 38 and 40 as the source of supplemental heat, and to use thermostats TU and TL in the control circuit. The installer would provide valve 64, which is a commercial item widely available.

Figure 2:
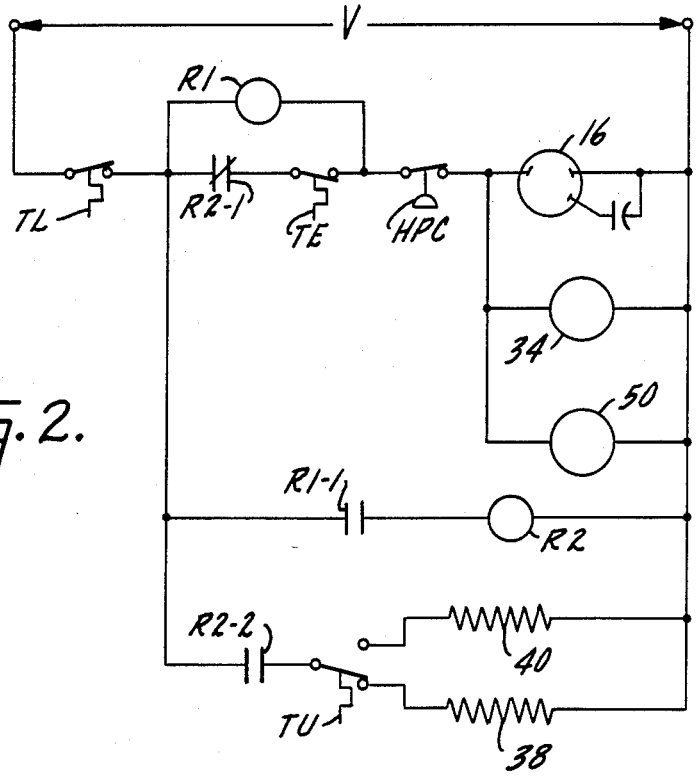
FIG. 2 is a schematic diagram of the control circuit for the system.

The control circuit is shown schematically in FIG. 2. The circuit includes a high-impedence relay R1 having a normally open relay contact R1-1. The circuit also includes a low-impedence relay R2 having a normally closed contact R2-1 and a normally open contact R2-2.

Across a suitable source of line voltage V is a series connection including thermostat TL, which is of the single pole-single throw type, relay contact R2-1, thermostat TE, which is of the single pole-single throw type, a suitable high-pressure cut-out switch HPC, and compressor 16. The coil of relay R1 is connected in parallel with relay contact R2-1 and thermostat TE. Fan motor 34 and pump 50 are connected in parallel with compressor 16.

Also connected in series across line voltage V are thermostat TL, relay contact R1-1, and the coil of relay R2.

Further connected in series across line voltage V are thermostat TL, relay contact R2-2, thermostat TU, which is of the single pole-double throw type, and heating element 38 or 40.

Thermostat TL normally is on, and switches off when water in the lower portion of tank 36 increases to a predetermined temperature setting, for example 140° F. Similarly, thermostat TE normally is on, and switches off when refrigerant temperature in evaporator 26 decreases to a predetermined temperature setting, for example 26° F., which is indicative of frost formation on evaporator 26. Thermostat TU normally is connected to heating element 38, and switches into connection with heating element 40 when water in the upper portion of tank 36 increases to a predetermined temperature setting, for example 135° F. or 140° F.

The operation of heat pump 12 is conventional. Compressor 16 compresses and heats refrigerant gas. This compressed hot gas is delivered to condenser 20, where it condenses into liquid refrigerant, in the process giving up heat to water flowing in coil 54. From condenser 20 liquid refrigerant passes through expansion device 24, where its pressure is reduced, to evaporator 26. There it boils and evaporates to provide expanded refrigerant gas for compressor 16.

The system operating cycle is controlled by the circuit shown in FIG. 2. When water temperature in the lower portion of tank 36 is at 140° F., thermostat TL is off. No current flows, and the system is shut down. The operating cycle begins when the temperature sensed by thermostat TL decreases below 140° F. Thermostat TL turns on, and current flows through thermostat TL, relay contact R2-1, thermostat TE, switch HPC, and compressor 16, fan motor 34, and pump 50. The operating cycle has been initiated, and heat pump 12 is heating water for storage in tank 36.

Thermostat TE normally is on. It is set to turn off when it senses that refrigerant temperature in evaporator 26 has decreased to 26° F., which corresponds approximately to a wet bulb temperature on evaporator 26 of slightly above 32° F. Thus, thermostat TE effectively senses the condition at evaporator 26 when frost begins to form thereon. So long as the temperature is high enough such that frost does not form, thermostat TE remains on, and heat pump 12 continues to operate. Because relay R1 is of the high-impedence type, relay contact R1-1 remains open. Relay R2 is not actuated, and relay contact R2-1 remains closed while relay contact R2-2 remains open. No current flows to heating element 38 or 40, and no supplemental heat is provided.

So long as no frost forms on evaporator 26, this operating condition prevails. The operating cycle is concluded when water temperature in the lower portion of tank 36 increases to 140° F., at which time thermostat TL turns off.

A turning point in the operating cycle is reached in the event thermostat TE senses a refrigerant temperature indicative of a condition where frost would begin to form on evaporator 26. At that point thermostat TE turns off. Current flowing through compressor 16, fan motor 34, and pump 50 must now flow through the coil of relay R1. As this is a high-impedence relay, the voltage drop across compressor 16, fan motor 34, and pump 50 is insufficient for their continued operation. Accordingly, heat pump 12 is turned off automatically. At the same time, relay contact R1-1 is closed, and current flows through the coil of relay R2. This causes relay contact R2-1 to open, and relay contact R2-2 to close.

When this occurs, heat pump 12 is effectively shut down for the remainder of the operating cycle, regardless of the temperature sensed by thermostat TE. Supplemental heat is provided automatically as current flows through relay contact R2-2, thermostat TU, and heating element 38 or 40.

Heating element 38 is energized to heat water in the upper portion of tank 36 until such time as its temperature increases to 140° F. or slightly below. When this predetermined temperature is sensed, thermostat TU switches from contact with heating element 38 to contact with heating element 40, with the result that heating element 40 is energized to heat water in the lower portion of tank 36. When this water temperature increases to 140° F., thermostat TL turns off, returning the elements of the control circuit to their original condition shown in FIG. 2, thus concluding the operating cycle.

The operating cycle is such that initially heat pump 12 is turned on. This condition prevails until either thermostat TL senses a predetermined temperature and heat pump 12 is turned off, or until thermostat TE senses the formation of frost on evaporator 26. If frost does form, heat pump 12 is turned off and the supplemental heat supply consisting of heating elements 38 and 40 is turned on. Heating element 38 is energized until thermostat TU senses a predetermined temperature. Thereafter, heating element 40 is energized until thermostat TL senses a predetermined temperature. At that point, the supplemental heat supply is turned off and the operating cycle is concluded.

Once compressor 16 has been shut down, it remains so until water in tank 36 has been heated and the operating cycle is concluded. This results in reduced wear and extended operating life for compressor 16.

It will be apparent to those skilled in the art that the invention disclosed herein provides a simple, efficient, easily constructed and installed heat pump water heater with supplemental heat supply. The heater is readily adaptable for production either as an equipment package for the new construction market or as an aftermarket package for on-site connection to a typical domestic hot water heater.

Thermostat TE is used in the preferred embodiment of this invention to sense a condition at which frost begins to form on evaporator 26. Similarly, upper and lower tank thermostats TU and TL, respectively, are used in the preferred embodiment of this invention to sense the temperature of water in tank 36. However, it should be understood that alternative sensing devices could be substituted for these thermostats. Also, it should be understood that alternative heating devices could be substituted for heating elements 38 and 40. Finally, the control circuit shown in FIG. 2 and used in the preferred embodiment of this invention has alternatives which will be apparent to those skilled in the art.

It should be understood that while the preferred embodiment of this invention has been shown and described, it is to be considered as illustrative and may be modified by those skilled in the art. It is intended that the claims herein cover all such modification as may fall within the spirit and scope of the invention.

What is claimed is:

1. A heat pump water heater with supplemental heat supply comprising heat pump means for heating water, said heat pump means including an evaporator, tank means cooperatively associated with said heat pump means for storing said water, supplemental water heating means, means for sensing the temperature of water in said tank means, and means for controlling the operating cycle of said heater, said control means including means for sensing the formation of frost on said evaporator, said control means initiating said operating cycle by turning on said heat pump means in response to sensing by said tank water temperature sensing means of a water temperature below a predetermined temperature, and concluding said operating cycle in the absence of the formation of frost on said evaporator by turning off said heat pump means in response to sensing by said tank water temperature sensing means of a water temperature at a predetermined temperature, said control means continuing said operating cycle in the event said frost sensing means senses the formation of frost on said evaporator by turning off said heat pump means and turning on said supplemental heating means, maintaining said heat pump means turned off and said supplemental heating means turned on until said operating cycle is concluded, and concluding said operating cycle by turning off said supplemental heating means in response to sensing by said tank water temperature sensing means of a water temperature at a predetermined temperature.

2. The heater of claim 1, said heat pump means including a compressor, a condenser, and an expansion device forming a refrigeration circuit with said evaporator, said control means turning said compressor on and off when said tank water temperature sensing means senses respectively that water temperature has decreased below and increased to a predetermined temperature, said control means turning off said compressor and turning on said supplemental heating means in the event said frost sensing means senses the formation of frost on said evaporator, and turning off said supplemental heating means when said tank water temperature sensing means senses that water temperature has increased to a predetermined temperature.

3. The heater of claim 2, said heat pump means including a fan for blowing air across said evaporator, said control means turning said compressor and fan on and off when said tank water temperature sensing means senses respectively that water temperature has decreased below and increased to a predetermined temperature, said control means turning off said compressor and fan and turning on said supplemental heating means in the event said frost sensing means senses the formation of frost on said evaporator, and turning off said supplemental heating means when said tank water temperature sensing means senses that water temperature has increased to a predetermined temperature.

4. The heater of claim 2, a pump forming a water circuit with said tank means and said condenser, said control means turning said compressor and pump on and off when said tank water temperature sensing means senses respectively that water temperature has decreased below and increased to a predetermined temperature, said control means turning off said compressor and pump and turning on said supplemental heating means in the event said frost sensing means senses the formation of frost on said evaporator, and turning off said supplemental heating means when said tank water temperature sensing means senses that water temperature has increased to a predetermined temperature.

5. The heater of claim 3, a pump forming a water circuit with said tank means and said condenser, said control means turning said compressor, pump, and fan on and off when said tank water temperature sensing means senses respectively that water temperature has decreased below and increased to a predetermined temperature, said control means turning off said compressor, pump, and fan and turning on said supplemental heating means in the event said frost sensing means senses the formation of frost on said evaporator, and turning off said supplemental heating means when said tank water temperature sensing means senses that water temperature has increased to a predetermined temperature.

6. The heater of claim 1, said control means maintaining said supplemental heating means turned off when said heat pump means is turned on.

7. The heater of claim 1, said frost sensing means including a thermostat for sensing refrigerant temperature.

8. The heater of claim 1, said frost sensing means including an evaporator thermostat for sensing the temperature of refrigerant in said evaporator.

9. A heat pump water heater with supplemental heat supply comprising a heat pump including a refrigeration circuit formed by a compressor, a condenser, an expansion device, and an evaporator having a fan; a hot water supply system including a tank, a cold make-up water inlet to said tank, a hot water supply outlet from said tank, upper and lower heating elements, and upper and lower tank thermostats; and means for controlling the operation of said heater, said control means including means for sensing the formation of frost on said evaporator; said control means turning on said compressor and fan when said lower tank thermostat senses a water temperature below a predetermined temperature and, in the absence of the formation of frost on said evaporator, turning off said compressor and fan when said lower tank thermostat senses a water temperature at a predetermined temperature; said control means, in the event said frost sensing means senses the formation of frost on said evaporator, turning off said compressor and fan and maintaining said compressor and fan turned off while sequentially turning on said upper heating element, turning off said upper heating element and turning on said lower heating element when said upper tank thermostat senses a water temperature at a predetermined temperature, and turning off said lower heating element when said lower tank thermostat senses a water temperature at a predetermined temperature.

10. The heater of claim 9, said frost sensing means including a thermostat for sensing refrigerant temperature.

11. The heater of claim 10, said thermostat being an evaporator thermostat for sensing the temperature of refrigerant in said evaporator.

12. The heater of claim 11, said control means further including a high-impedence relay having a normally open contact, and a low-impedance relay having a first normally closed contact and a second normally open contact; said lower tank thermostat, first low-impedence relay contact, evaporator thermostat, and compressor connected in series across a voltage source, and said high-impedence relay coil connected in parallel with said first low-impedence relay contact and evaporator thermostat; said lower tank thermostat, high-impedence relay contact, and low-impedence relay coil connected in series across said voltage source; and said lower tank thermostat, second low-impedence relay contact, upper tank thermostat, and either of said upper or lower heating elements connected in series across said voltage source.

13. The heater of claim 12, said lower tank thermostat being normally on and adapted to turn off when it senses that water temperature in said tank has increased to a predetermined temperature; said evaporator thermostat being normally on and adapted to turn off when it senses that refrigerant temperature in said evaporator has decreased to a predetermined temperature; and said upper tank thermostat being of the single pole-double throw type for connection with either of said upper or lower heating elements, said upper tank thermostat being normally connected to said upper heating element and adapted for connection to said lower heating element when it senses that water temperature in said tank has increased to a predetermined temperature.

14. The heater of claim 12, said fan being connected in parallel with said compressor.

15. The heater of claim 13, said fan being connected in parallel with said compressor.

16. The heater of claim 12, said hot water supply system further including a pump forming a water circuit with said tank and condenser, said pump being connected in parallel with said compressor.

17. The heater of claim 13, said hot water supply system further including a pump forming a water circuit with said tank and condenser, said pump being connected in parallel with said compressor.

18. The heater of claim 14, said hot water supply system further including a pump forming a water circuit with said tank and condenser, said pump being connected in parallel with said compressor and fan.

19. The heater of claim 15, said hot water supply system further including a pump forming a water circuit with said tank and condenser, said pump being connected in parallel with said compressor and fan.

20. The heater of claim 14, said control means further including a high-pressure cut-off switch in series with said lower tank thermostat, first low-impedence relay contact, evaporator thermostat, and compressor.

* * * * *